US010714845B2

(12) United States Patent
Shanmugam

(10) Patent No.: US 10,714,845 B2
(45) Date of Patent: Jul. 14, 2020

(54) ELECTRICAL CONNECTOR

(71) Applicant: Hubbell Incorporated, Shelton, CT (US)

(72) Inventor: Prasanna Shanmugam, Tamil nadu (IN)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/401,596

(22) Filed: May 2, 2019

(65) Prior Publication Data

US 2020/0136275 A1 Apr. 30, 2020

(30) Foreign Application Priority Data

Oct. 25, 2018 (IN) ..... 201821040229

(51) Int. Cl.
*H01R 4/44* (2006.01)
*H01R 4/48* (2006.01)
*H01R 11/09* (2006.01)

(52) U.S. Cl.
CPC ..... *H01R 4/44* (2013.01); *H01R 4/4854* (2013.01); *H01R 11/09* (2013.01)

(58) Field of Classification Search
CPC ..... H01R 4/44; H01R 4/4854; H01R 11/09
USPC ..... 439/781
See application file for complete search history.

(56) References Cited

U.S. PATENT DOCUMENTS 4,684,196 A * 8/1987 Smith ..... H01R 4/2408 439/411
4,707,051 A * 11/1987 Hall ..... H01R 4/44 439/781
4,985,003 A * 1/1991 Francois ..... H01R 4/44 439/475
5,752,860 A * 5/1998 Greaves ..... H01R 4/44 439/100
7,309,263 B2 * 12/2007 Copper ..... H01R 4/38 439/284
7,666,024 B2 * 2/2010 De France ..... H01R 4/4872 439/479
7,862,390 B2 * 1/2011 Copper ..... H01R 4/5091 439/781
8,469,721 B2 * 6/2013 Mitchell ..... H01R 4/44 439/66
9,577,351 B2 * 2/2017 Martin ..... H01R 4/2408
(Continued)

*Primary Examiner* — Harshad C Patel
(74) *Attorney, Agent, or Firm* — Ohlandt, Greeley, Ruggiero & Perle, LLP

(57) ABSTRACT

An electrical connector includes two pads having the same shape. Each pad has a connector body with a first groove, a second groove, and a hole. The hole extends through the connector body between the first groove and the second groove. A fastener extends through the hole of both of the two pads so that the two pads having the same shape are connected to one another and are pivotable around the fastener relative to one another with the two first grooves contacting a first conductor when the first conductor is in an installed position and the two second grooves contacting a second conductor when the second conductor is in an installed position. A spring is between a first end of the fastener and one of the two pads having the same shape so that the spring biases the two pads having the same shape towards each other.

17 Claims, 12 Drawing Sheets

(56) References Cited

U.S. PATENT DOCUMENTS

| | | | | |
|---|---|---|---|---|
| 2010/0011571 | A1* | 1/2010 | Copper | H01R 4/5091 29/758 |
| 2015/0377275 | A1* | 12/2015 | De France | F16G 11/00 411/10 |
| 2016/0020529 | A1* | 1/2016 | Martin | H01R 4/2408 439/391 |
| 2016/0294074 | A1 | 10/2016 | De France et al. | |

* cited by examiner

96326

ELECTRICAL CONNECTOR

CROSS REFERENCE TO RELATED APPLICATIONS

This application claims benefit under 35 USC § 119 of Indian Application No. 201821040229 filed Oct. 25, 2018, the entire contents of which are incorporated herein by reference.

BACKGROUND OF THE DISCLOSURE

1. Field of the Disclosure

The present disclosure relates to electrical connectors. More particularly, the present disclosure relates to electrical connectors that clamp two electrical conductors between two pads having the same shape.

1. Description of the Related Art

There are conventional methods to connect, or tap, a tap line to an overhead power distribution line extending from a utility pole. In India, for example, currently this tapping is done by "wire binding" where a wire is wound around the tap line and the overhead power distribution line. However, wire binding has undesirable contact resistance, I squared R losses and heat on joints, and results in undesirable conductor life. Other conventional methods of tapping require an undesirable cost of installation, installation time, safety of installation and/or reliability.

Accordingly, there is a need to address these disadvantages of currently available systems.

SUMMARY OF THE DISCLOSURE

An electrical connector is provided that includes two pads having the same shape. Each pad comprises a connector body having a first groove, a second groove, and a hole. The hole extends through the connector body between the first groove and the second groove. A fastener extends through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position. A spring is between a first end of the fastener and one of the two pads having the same shape so that the spring biases the two pads having the same shape towards each other. The connector body further includes a protruding tab on a first side and a side groove on a second side so that, when the two pads having the same shape are connected to one another, the protruding tabs are received in the side grooves, respectively.

The side groove can be sized to limit movement of the protruding tab.

An electrical connector is also provided that has two pads having the same shape. Each pad comprises a connector body having a first groove, a second groove, and a hole. The hole extends through the connector body between the first groove and the second groove. A fastener extends through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position. A spring is between a first end of the fastener and one of the two pads having the same shape so that the spring biases the two pads having the same shape towards each other. The first groove has a first outer surface comprising a first flange and a first recess. The first flange extends inward from a first side of the connector body a distance of half or less half an entire length of the first groove and the first recess extends inward from a second side of the connector body at least the distance of the first flange so that, when the two pads having the same shape are connected to one another, the first flanges are opposite and the first recesses, respectively.

The second groove can have a second outer surface comprising a second flange and a second recess. The second flange can extend inward from a second side of the connector body a distance of half or less half an entire length of the second groove and the second recess can extend inward from the second side of the connector body at least the distance of the second flange so that, when the two pads having the same shape are connected to one another, the second flanges are opposite and the second recesses, respectively. The first flange can be formed by a first receiving flange and a first protrusion. The first receiving flange can extend from the first groove at an angled direction away from the first groove and the protrusion can be formed where the first receiving flange and the first groove meet and extends in a direction toward the first groove. The first receiving flange can have a length of greater than 0.84 inches. The second flanges can overlap the first recesses, respectively, when the second groove is free of the second conductor. The two pads having the same shape that receive the first conductor that can have a diameter between 0.162 inches to 0.563 inches. The two pads having the same shape that receive the second conductor that can have a diameter between 0.563 inches to 0.953 inches.

An electrical connector is further provided that includes two pads having the same shape. Each pad comprises a connector body having a first groove, a second groove, and a hole. The hole extends through the connector body between the first groove and the second groove. A fastener extends through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position. A spring is between a first end of the fastener and one of the two pads having the same shape so that the spring biases the two pads having the same shape towards each other. The hole comprises an elongated portion and a recessed portion. The spring is received in the recessed portion of one of the two pads having the same shape and a second end of the fastener is received in the recessed portion of the other of the two pads having the same shape.

The fastener can have a fastener head and a fastener body. The recessed portion can have a corresponding shape to the fastener head to prevent rotation of fastener in the opening. The recessed portion can have a shape that corresponds to a shape of the spring to seat the spring. The fastener that is a bolt can have a head and a bolt body. A Belleville washer can be secured on the bolt body with a nut. The bolt can be connected to the two pads having the same shape by a shear-nut.

The above-described and other advantages and features of the present disclosure will be appreciated and understood by those skilled in the art from the following detailed description, drawings, and appended claims.

DETAILED DESCRIPTION OF THE DISCLOSURE

Figure 1:
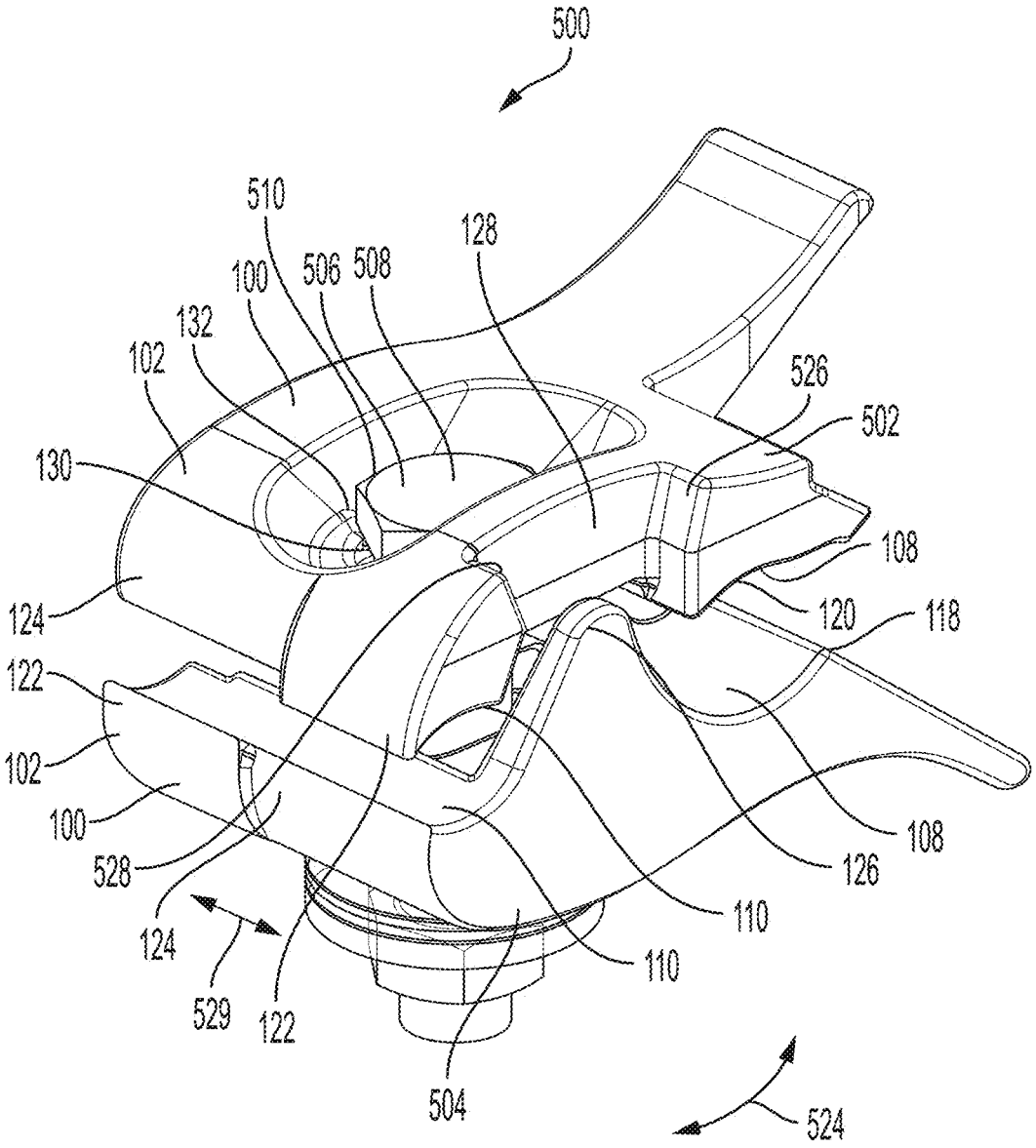
FIG. 1 is a top, front perspective view of an electrical connector.
Figure 2:
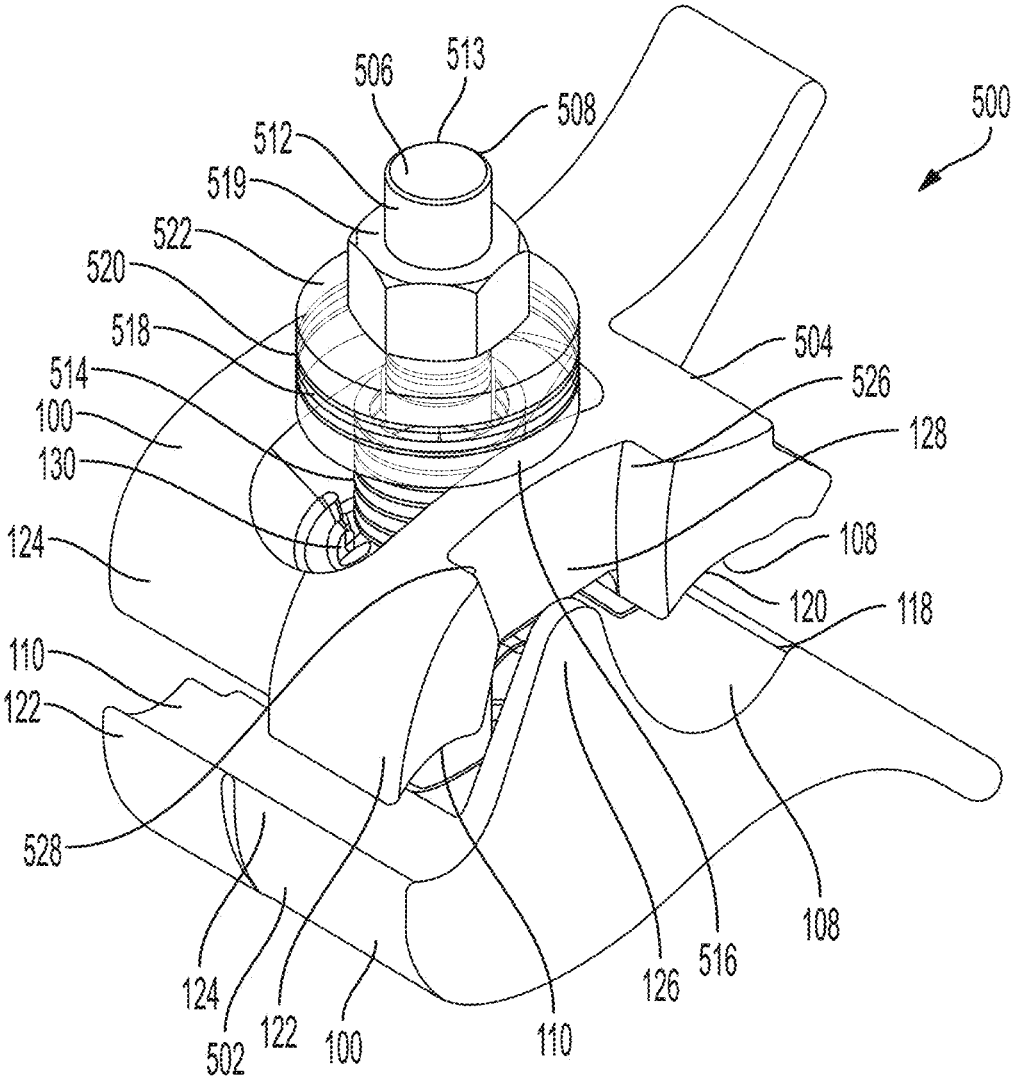
FIG. 2 is a bottom, front perspective view of the electrical connector of FIG. 1 with pads being moved away from each other relative to FIG. 1 and having washers shown as transparent.

Referring to FIGS. 1 and 2, an electrical connector 500 of the present disclosure is shown. Electrical connector 500 has two pads 100 having the same shape. Two pads 100 having the same shape allows pads 100 to be a single cast part reducing tooling cost and achieving material and cost reduction over electrical connector assemblies that have pads that are different shapes.

Each of pads 100 has a connector body 102 having a first groove 108, a second groove 110, and a hole 130. Hole 130 extends through connector body 102 between first groove 108 and the second groove 110. Electrical connector 500 has a fastener 506 extending through hole 130 of both of pads 100 so that pads 100 are connected to one another and are pivotable around fastener 506 relative to one another with the two first grooves 108 contacting a first conductor when the first conductor is in an installed position and the two second grooves 110 contacting a second conductor when the first conductor is in an installed position. A spring 514 is on fastener 506 that biases two pads 100 having the same shape towards each other.

Figure 3:
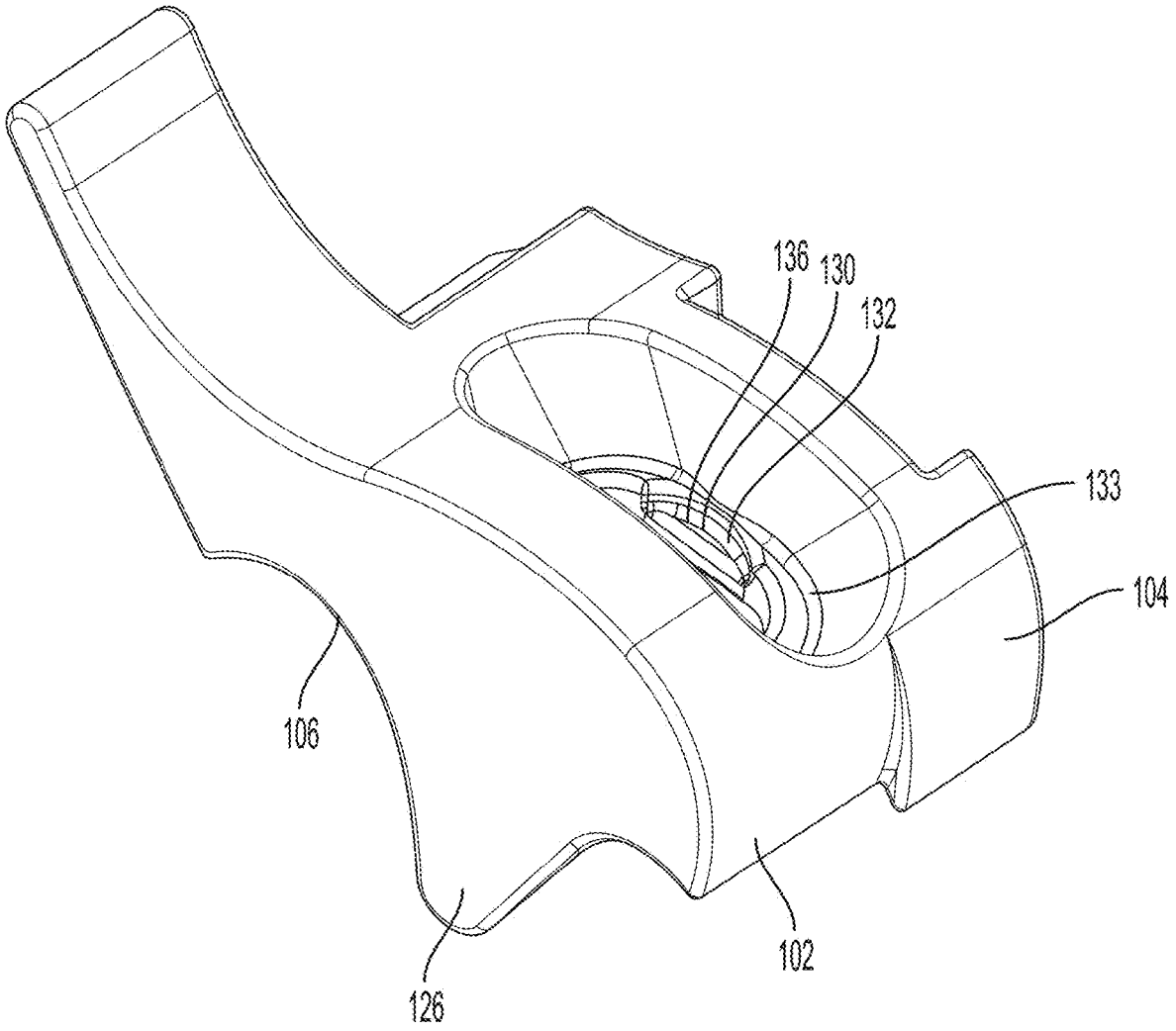
FIG. 3 is a top, front perspective view of one of the pads of the electrical connector of FIG. 1.
Figure 4:
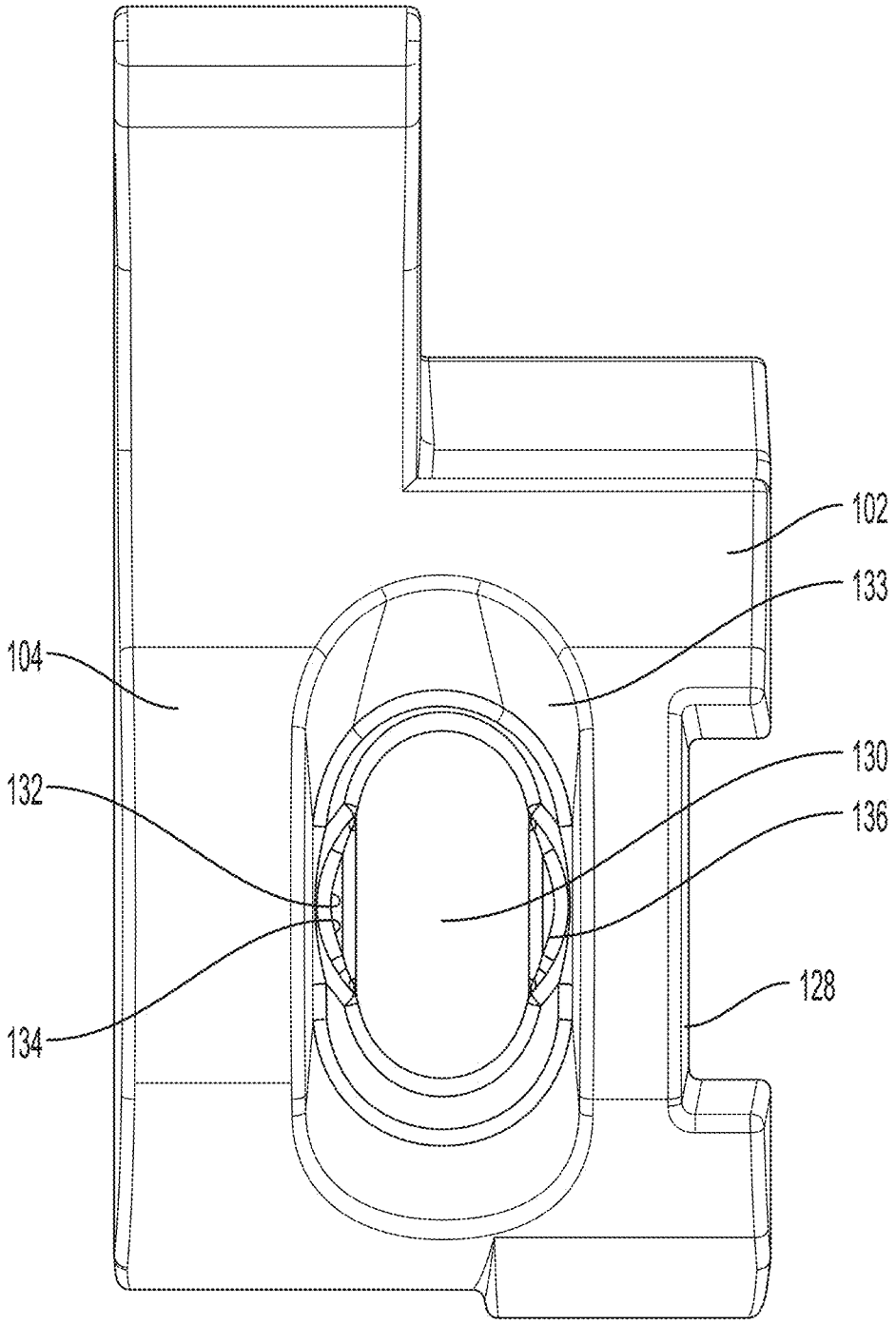
FIG. 4 is a top view of the pad of FIG. 3.

Referring to FIGS. 3 and 4, connector body 102 has hole 130 extending from an outer side 104 to an inner side 106. Hole 130 has a recessed portion 132 and an elongated portion 133 in outer side 104. Hole 130 has recessed portion 132 surrounding at least a portion of hole 130 on outer side 104. Recessed portion 132 has first depression 134 and second depression 136 on opposite sides of hole 130. Hole 130 has an elongated shape, for example, a stadium or oval shape.

Figure 5:
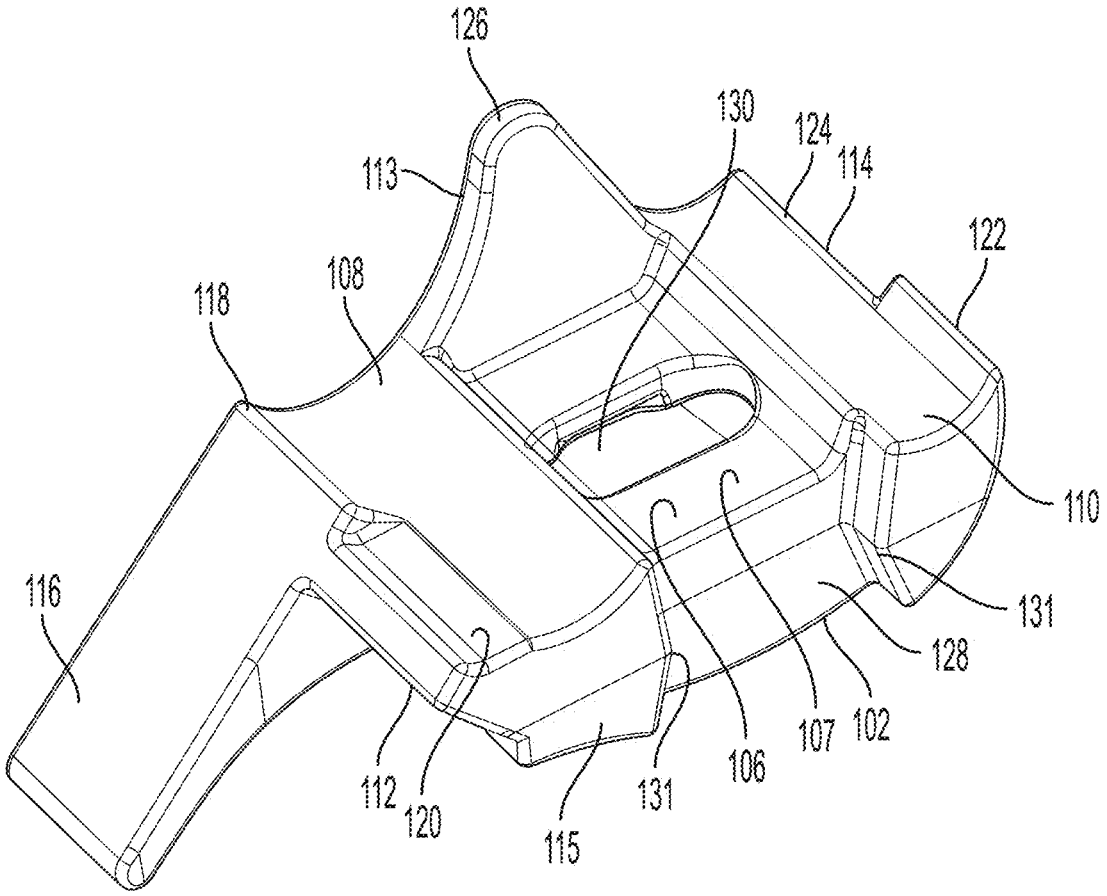
FIG. 5 is a bottom, rear perspective view of the pad of FIG. 3.
Figure 6:
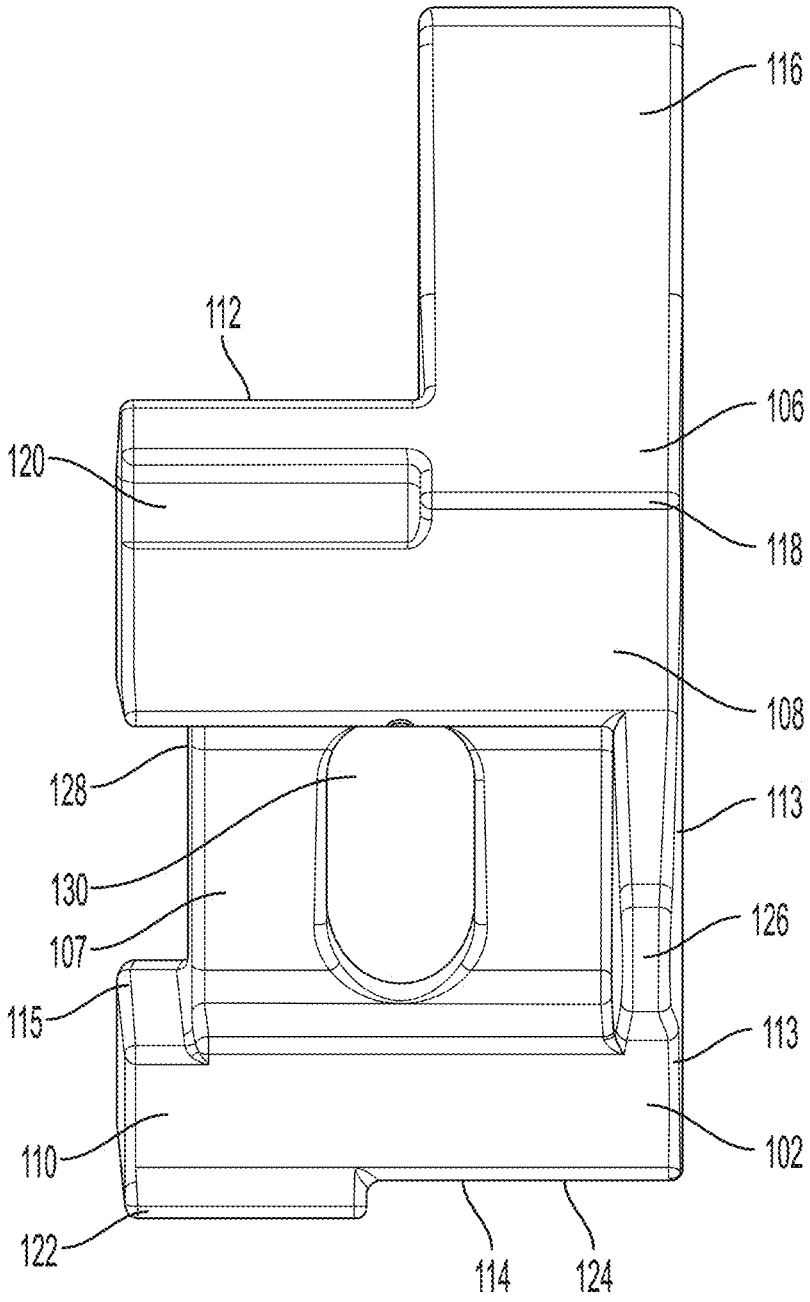
FIG. 6 is a bottom view of the pad of FIG. 3.
Figure 7:
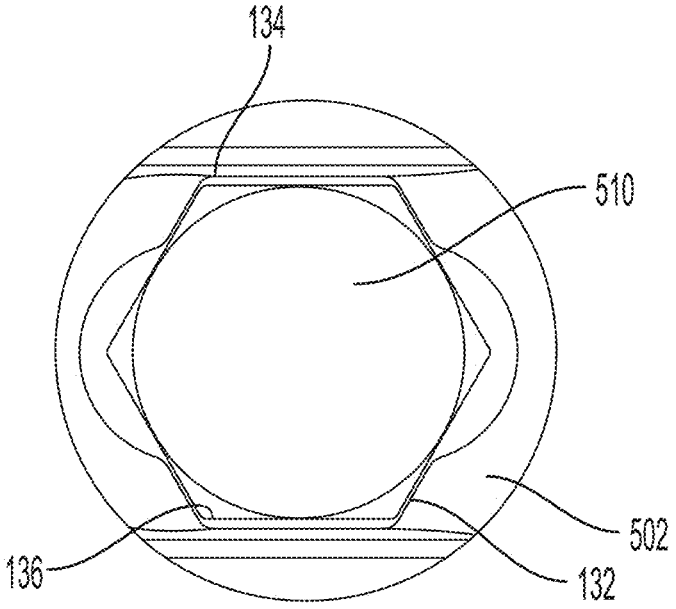
FIG. 7 is an enlarged partial top view of the electrical connector of FIG. 1.

Referring to FIGS. 5 and 6, inner side 106 has first groove 108 and second groove 110. Inner side 106 has a depressed area 107 between first groove 108 and second groove 110. Connector body 102 has a first end 112 that is between outer side 104 and the inner side 106 and a second end 114 opposite to first end 112 between outer side 104 and inner side 106. Connector body 102 has a first side 113 between outer side 104, inner side 106, first end 112 and second end 114. Connector body 102 has a second side 115 opposite the first side.

First end 112 has a first receiving flange 116 extending from first groove 108 that is angled in a direction away from first groove 108. First receiving flange 116 has a length, for example, of greater than 0.84 inches, and, a further example, a length of 1.213 inches. A length 908 (FIG. 9A) of first receiving flange 116 of 1.213 inches as compared to a length of 0.84 inches creates a raised duckbill shape to enable lineman to access electrical connector 500 comfortably with dielectric gloves on, avoids slippage due to sufficient hand-grip space, and provides ease of installation. Outer side 104 is a convex curved shape that transitions to a concave curved shape before first receiving flange 116 extends from outer side 104. First end 112 forms a protrusion 118 where first receiving flange 116 and first groove 108 meet. Protrusion 118 extends in a direction toward first groove 108. First end 112 has a first recess 120 adjacent first receiving flange 116.

Second end 114 has a first end flange 122 extending from second groove 110 that is angled in a direction toward second groove 110. First end flange 122 extends along only a portion of second end 114 and is adjacent a second recess 124 of second end 114.

First side 113 has a protruding tab 126 extending in a direction away from inner side 106. Protruding tab 126 tapers in size in the direction away from inner side 106. A first side of protruding tab 126 adjacent first groove 108 may be a concave curve and the second side of protruding tab 126 adjacent second groove 110 may be a convex curve. Second side 115 has a side groove 128. Side groove 128 tapers inward from inner side 106 up to a point 131 and tapers inward from point 131 to outer side 104. Both the tapers on either side of point 131 enables easy removal of pads 100 from their casts during casting process.

Referring back to FIGS. 1 and 2, pads 100 having the same shape are a first pad 502 and a second pad 504 that are connected by fastener 506 of electrical connector 500 aligning first groove 108 of first pad 502 with first groove 108 of second pad 504 and second groove 110 of first pad 502 with second groove 110 of the second pad 504. Fastener 506 is a bolt 508 having a head 510 and a bolt body 512. Bolt 508 is a hex bolt such as a standard hex bolt ⅜–16×2.50. Bolt body 512 is received through hole 130 of first pad 502 so that recessed portion 132 receives head 510. Referring to FIG. 4, first depression 134 receives a first side of head 510 and second depression 136 receives an opposite side of head 510. Recessed portion 132 receives head 510 to prevent rotation between head 510 and connector body 102 of first pad 502.

Figure 8:
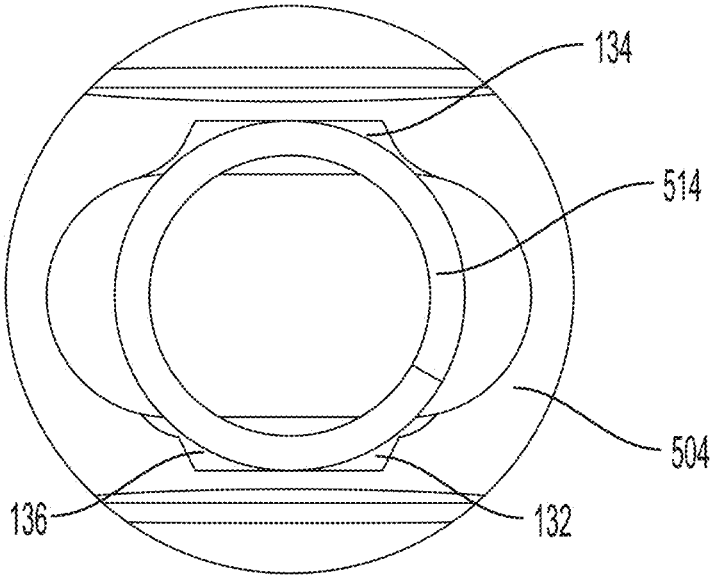
FIG. 8 is an enlarged partial bottom view of the pad of FIG. 3 with a spring in a depression in the pad.

Referring back to FIGS. 1 and 2, bolt body 512 is received through hole 130 of first pad 502 from outer side 104 to inner side 106 and second pad 504 from inner side 106 to outer side 104. Referring to FIG. 8, recessed portion 132 of second pad 504 receives a portion of a spring 514. Spring 514 is a compression spring such as std SS (ASTM 313) compression spring. First depression 134 of second pad 504 receives a first side of spring 514 and second depression 136 of second pad 504 receives an opposite side of spring 514. Recessed portion 132 of second pad 504 receives the portion of spring 514 to be a seat that receives and supports spring 514. Bolt body 512 receives a first flat washer 516, a first Belleview washer 518 having its conical shape tapering in a first direction toward second pad 504, a second Belleview washer 520 having its conical shape tapering in an opposite direction than the first Belleview washer 518 and a second flat washer 522 to support spring 514. First flat washer 516, first Belleview washer 518, second Belleview washer 518, second flat washer 522 and spring 514 are secured on bolt body 512 by a nut 519 so that spring 514 abuts recessed portion 132 of second pad 504. Nut 519 can be a hex nut, for example, a standard hex nut, ⅜-16. Bolt body 512 passes through hole 130 of second pad 504 and spring 514 so that first pad 502 and second pad 504 are between head 508 and spring 514 and spring 514 biases second pad 504 against first pad 502. Use of first flat washer 516, first Belleview washer 518, second Belleview washer 518, and second flat washer 522 with electrical connector 500 that is a spring loaded connector enables support of high loads with minimal deflections, helps in absorbing vibrations and other external disturbances to spring 514, and reduces vibrations so that nut 519 will not backout from fastener 506 during loads and vibrations, which increases safety and reliability. Use of first flat washer 516, first Belleview washer 518, second Belleview washer 518, and second flat washer 522 with electrical connector 500 does not require a change to bolt body 512 height as compared with electrical connector 500 that does not include first flat washer 516, first Belleview washer 518, second Belleview washer 518, second flat washer 522.

Recessed portion 132 surrounding at least a portion of hole 130 is able to selectively receive one of at least a portion of fastener 506 and at least a portion of a spring 514 depending on whether pad 100 is being used as first pad 502 or second pad 504 to maintain fastener 506 or spring 514 stationary. Recessed portion 132 surrounding at least a portion of hole 130 that is able to selectively receive one of at least a portion of fastener 506 and at least a portion of a spring 514 provides ease of installation. Fastener 506 also limits side-to-side movement as shown by arrows 529 of first pad 502 and second pad 504 as shown in FIG. 1. Depression 136 creates an under-cut feature to lock head 508 in position and thereby prevent its rotation while torque is applied on bolt body 512 when nut 519 is connected on bolt body 512 to provide ease of installation. Depression 136 conceals head 510 within connector body 102 which creates a "Concealed Hex-Head" feature that also improves the aesthetics of electrical connector 500. Depression 136 reduces material of a connector "cap" of connector body 102 that is an added advantage over connector bodies that do not have depression 136.

Referring back to FIG. 1, first pad 502 is connected to second pad 504 so that protruding tab 126 of first pad 502 is in side groove 128 of second pad 504 and protruding tab 126 of second pad 504 is in side groove 128 of first pad 502. Protruding tab 126 of first pad 502 being in side groove 128 of second pad 504 and protruding tab 126 of second pad 504 being in side groove 128 of first pad 502 limits pivoting movement as shown by arrows 524 of at least one of first pad 502 and second pad 504 around fastener. Hole 130 of each of first pad 502 and second pad 504 are sized and shaped to also limit pivoting movement about fastener 506. Movement of protruding tab 126 of first pad 502 is limited to movement between side walls 526, 528 of side groove 128 of second pad 504 that limits relative movement between first pad 502 and second pad 504. Movement of protruding tab 126 of second pad 504 is limited to movement between side walls 526, 528 of side groove 128 of first pad 502 that limits relative movement between first pad 502 and second pad 504.

Still referring to FIG. 1, protrusion 118 of first pad 502 is aligned with first recess 120 of second pad 504 and protrusion 118 of second pad 504 is aligned with the first recess 120 of first pad 502. End flange 122 of first pad 502 is aligned with second recess 124 of second pad 504 and end flange 122 of second pad 504 is aligned with second recess 124 of first pad 502. When there are no conductors between first pad 502 and second pad 504, end flange 122 of first pad 502 overlaps second recess 124 of second pad 504 and end flange 122 of second pad 504 overlaps second recess 124 of first pad 502.

Figure 9A:
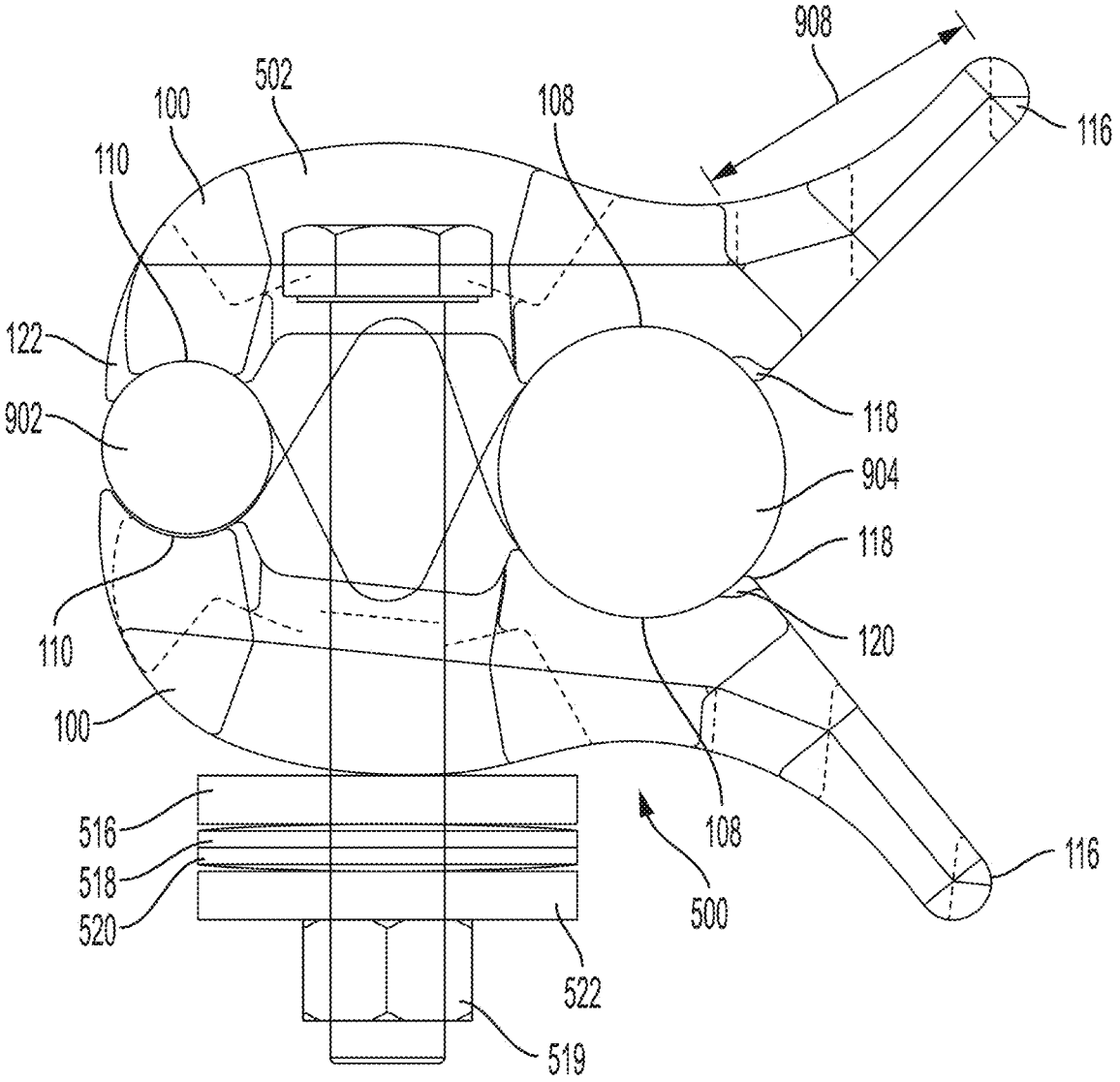
FIG. 9A is a side view of the electrical connector of FIG. 1 connected to a first conductor and a second conductor.

As shown in FIG. 9A, electrical connector 500 having pads 100 is configured to electrically connect a first conductor 902 and a second conductor 904. Second conductor 904 may be a main conductor such as a run cable or feeder cable, and first conductor 902 may be a tap line or tap conductor. However, it should be understood that any combination of conductor types or sizes may be accommodated such as Aluminum Cable Steel Reinforced (ACSR), copper, aluminum, aluminum alloy 6201, and aluminum alloy 5005, for example. In particular, electrical connector 500 provides a spring loaded parallel clamp that can be easily installed (when compared to conventional configurations) to connect a tap line, for example, first conductor 902, to an overhead power distribution line, for example, second conductor 904, on a utility pole using a utility lineman's hot stick.

Figure 9C:
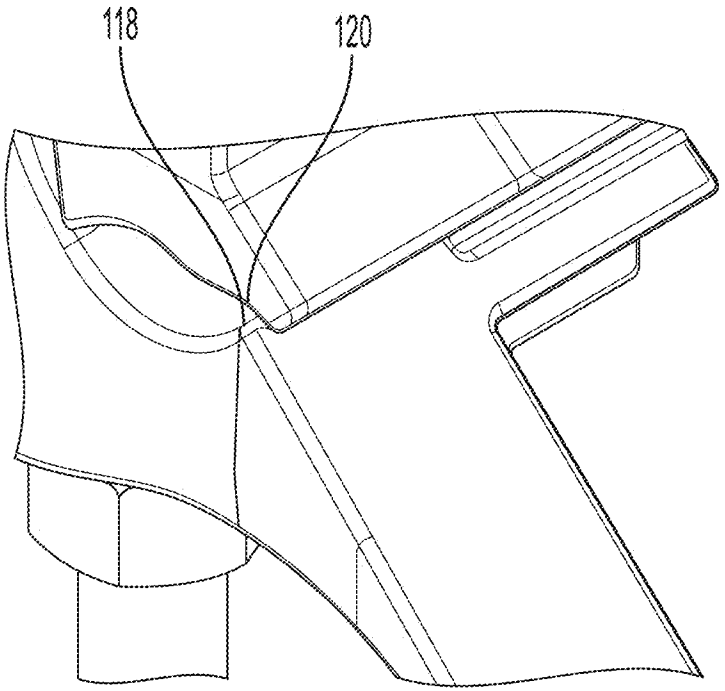
FIG. 9C is an enlarged second side rear perspective view of the electrical connector of FIG. 1.
Figure 9B:
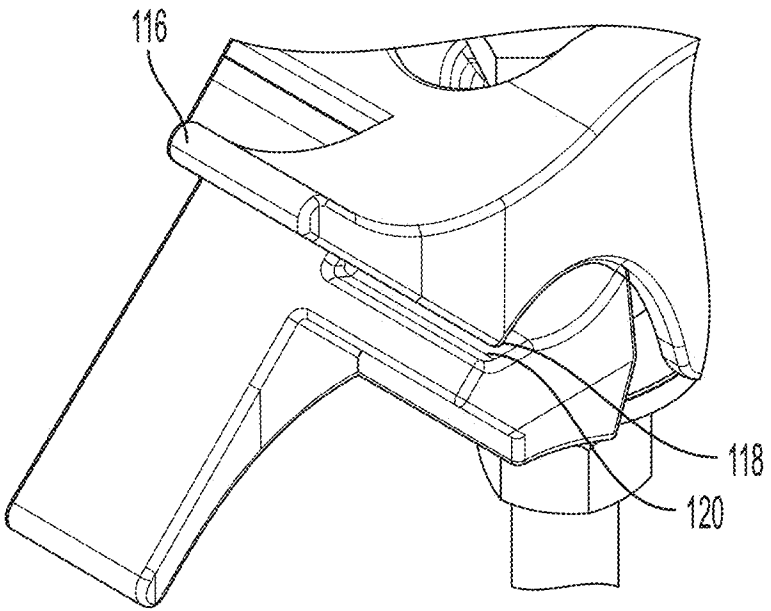
FIG. 9B is an enlarged first side rear perspective view of the electrical connector of FIG. 1.

Referring to FIGS. 9A-9C, in use, a force is applied to first pad 502, second pad 504, or both first pad 502 and second pad 504 to overcome a force applied by spring 514 biasing first pad 502 against second pad 504 to move first pad 502 and second pad 504 a distance a part to receive first conductor 902. Second groove 110 of first pad 502 is aligned with second groove 110 of the second pad 504 to receive first conductor 902. At least one of first pad 502 and second pad 504 is pivotable around fastener 506 while maintaining alignment of first groove 108 of first pad 502 with first groove 108 of second pad 502 and the alignment of second groove 110 of first pad 502 with second groove 110 of second pad 504. This alignment is maintained by one or more of depression 136 of first pad 502 receiving head 510, depression 136 of second pad 504 receiving spring 514, fastener 506 being through hole 130 of first pad 502, fastener 506 being through hole 130 of second pad 504, protruding tab 126 of first pad 502 being in side groove 128 of second pad 504, and protruding tab 126 of second pad 504 being in side groove 128 of first pad 502. Hole 130 of each of first pad 502 and second pad 504 are sized and shaped to allow pivoting movement about fastener 506. When the force is removed, first pad 502 and second pad 504 are again biased together to maintain first conductor 902 between second groove 110 of first pad 502 and second groove 110 of second pad 504 so that first conductor 902 contacts first pad 502, second pad 504 or both first pad 502 and second pad 504. First end flange 122 of first pad 502 extends along a first length of first conductor 902 and first end flange 122 of the second pad 504 extends along a second length of first conductor 902 that is adjacent the first length so that the first length and the second length extend along a majority of first conductor 902. First end flange 122 extends a distance of half or less half an entire length of second groove 110 and second recess 124 that extends inward extends at least the distance of first flange 122 so that, when first pad 502 and second pad 504 having the same shape are connected to one another, first flanges 122 are opposite and second recesses 124, respectively. First end flange 122 of first pad 502 and first end flange 122 of the second pad 504 prevent first conductor 902 from slipping out of electrical connector 500 during installation creating an anti back-out feature, which saves on installation time, increases safety and avoids slippage of first conductor 902.

Also, in use, a force is applied to first pad 502, second pad 504, or both first pad 502 and second pad 504 to overcome a force applied by spring 514 biasing first pad 502 against second pad 504 to move first pad 502 and second pad 504 a distance a part to receive second conductor 904. At least one of first pad 502 and second pad 504 is pivotable around fastener 506 while maintaining alignment of first groove 108 of first pad 502 with first groove 108 of second pad 502 and the alignment of second groove 110 of first pad 502 with second groove 110 of second pad 504. First groove 108 of first pad 502 is aligned with first groove 108 of second pad 504 to receive second conductor 904. This alignment is maintained by one or more of depression 136 of first pad 502 receiving head 510, depression 136 of second pad 504 receiving spring 514, fastener 506 being through hole 130 of first pad 502, fastener 506 being through hole 130 through second pad 504, protruding tab 126 of first pad 502 being in side groove 128 of second pad 504, and protruding tab 126 of second pad 504 being in side groove 128 of first pad 502. First receiving flange 116 of first pad 502 and first receiving flange 116 of second pad 504 guide second conductor 904 into first groove 108 of first pad 502 and first groove 108 of second pad 504. First recess 120 of first pad 502 has a depressed shape so that contact of protrusion 118 of the second pad 504 on first recess 120 of the first pad 502 under compression by spring 514 results in smooth movement between first pad 502 and second pad 504. First recess 120 of the second pad 504 has a depressed shape so that contact of protrusion 118 of the first pad 502 on first recess 120 of the second pad 504 under compression by spring 514 results in smooth movement between first pad 502 and second pad 504. When the force is removed, first pad 502 and second pad 504 are again biased together to maintain second conductor 904 between first groove 108 of first pad 502 and first groove 108 of the second pad 504 so that second conductor 904 contacts first pad 502, second pad 504 or both first pad 502 and second pad 504. Protrusion 118 of first pad 502 and first recess 120 of second pad 504 extend along a first length of second conductor 904 and protrusion 118 of the second pad 504 and first recess 120 of first pad 502 extends along a second length of second conductor 904 that is adjacent the first length so that the first length and the second length extend along a majority of second conductor 904. Protrusion 118 extends a distance of half or less half an entire length of first groove 108 and first recess 120 that extends inward extends at least the distance of protrusion 118 so that, when first pad 502 and second pad 504 having the same shape are connected to one another, protrusions 118 are opposite and first recesses 120, respectively. Protrusion 118 of first pad 502 and first recess 120 of second pad 504 and protrusion 118 of the second pad 504 and first recess 120 of first pad 502 prevent second conductor 904 from slipping out of electrical connector 500 during installation creating an anti back-out feature, which saves on installation time, increases safety and avoids slippage of second conductor 904.

The installation described above may be accomplished by attaching a utility lineman's hot stick to an end of fastener 506 and/or nut 519 extending from the bottom side of second pad 504. Electrical connector 500 provides a spring loaded parallel clamp that can be easily installed (when compared to conventional configurations) to connect a tap line to an overhead power distribution line on a utility pole using a utility lineman's hot stick.

Figure 11:
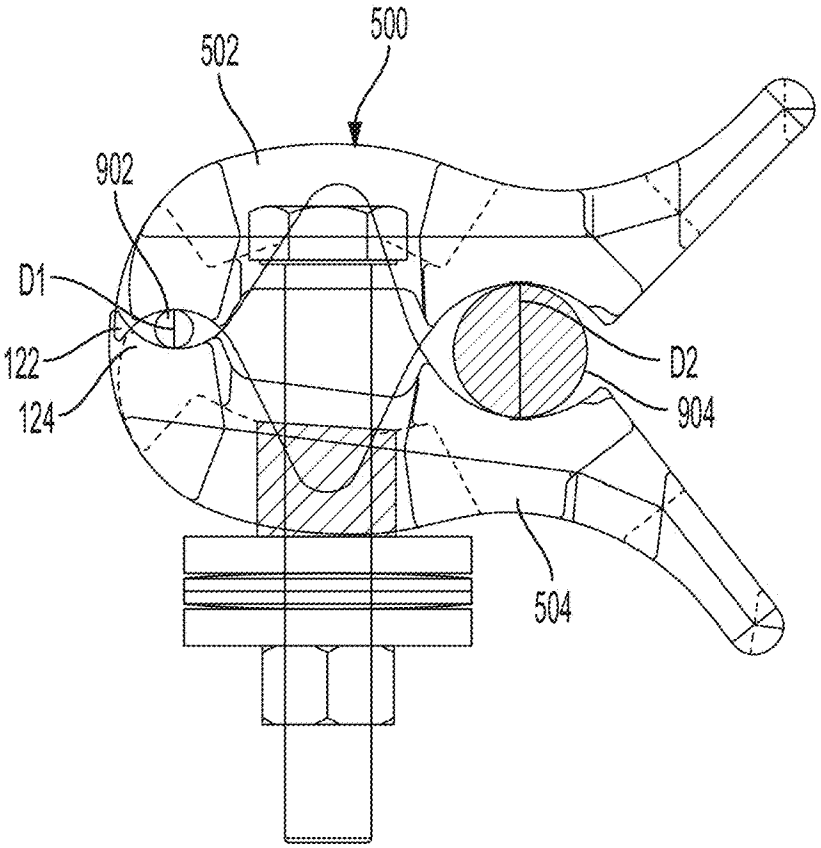
FIG. 11 is a side view of the electrical connector of FIG. 1 connected to the first conductor having a size that is different than the size of the first conductor of FIG. 10 and the second conductor.
Figure 10:
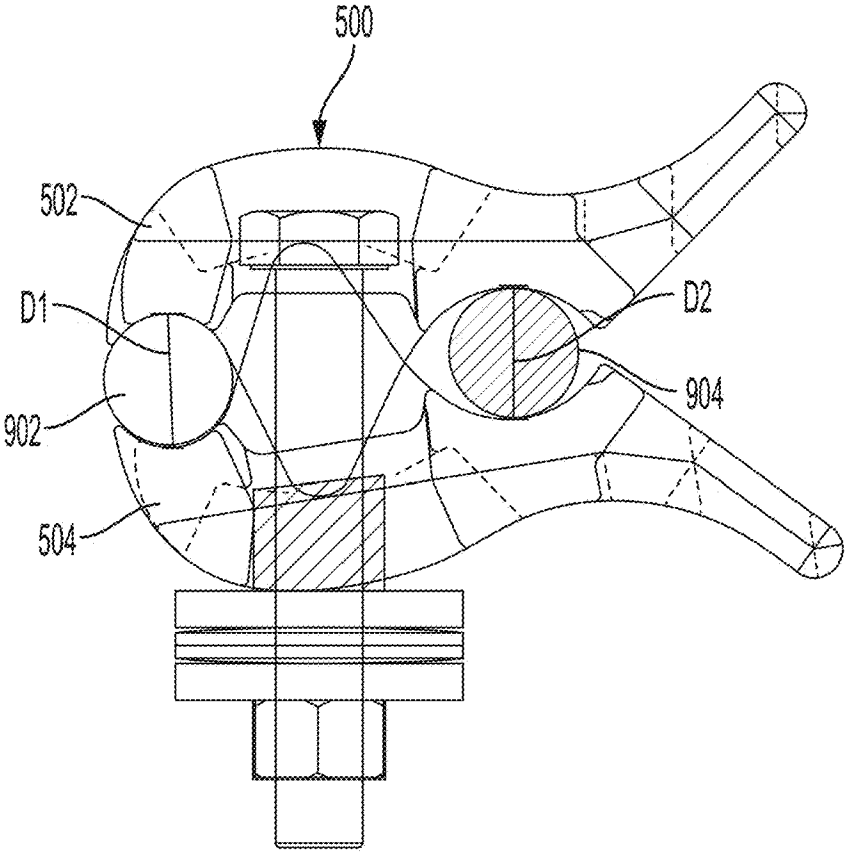
FIG. 10 is a side view of the electrical connector of FIG. 1 connected to the first conductor and the second conductor.
Figure 13:
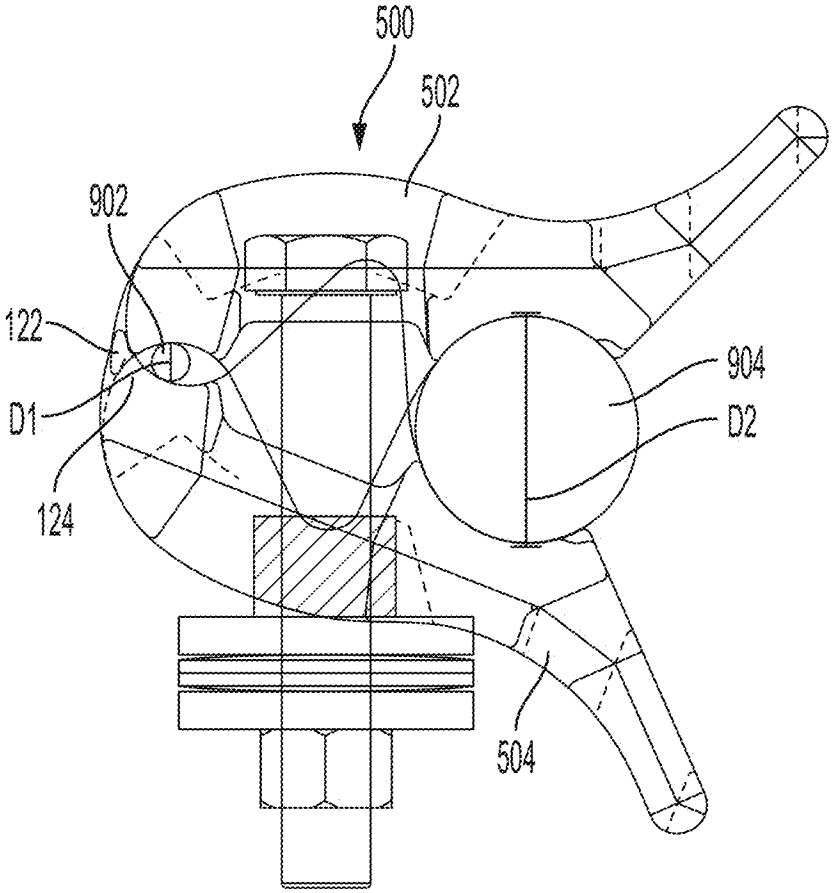
FIG. 13 is a side view of the electrical connector of FIG. 1 connected to the first conductor having the size of the first conductor of FIG. 11 and the second conductor having the size of the second conductor of FIG. 12.
Figure 12:
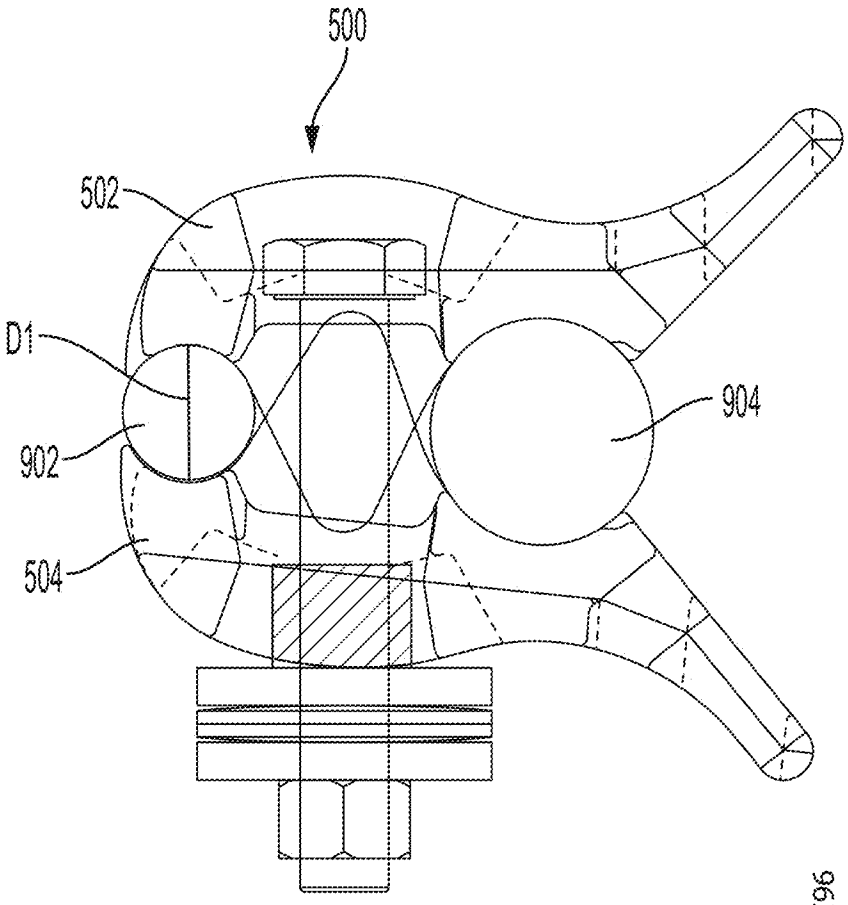
FIG. 12 is a side view of the electrical connector of FIG. 1 connected to the first conductor having the size of the first conductor of FIG. 10 and the second conductor having a size that is different than the size of the second conductor of FIG. 10.
Figure 14:
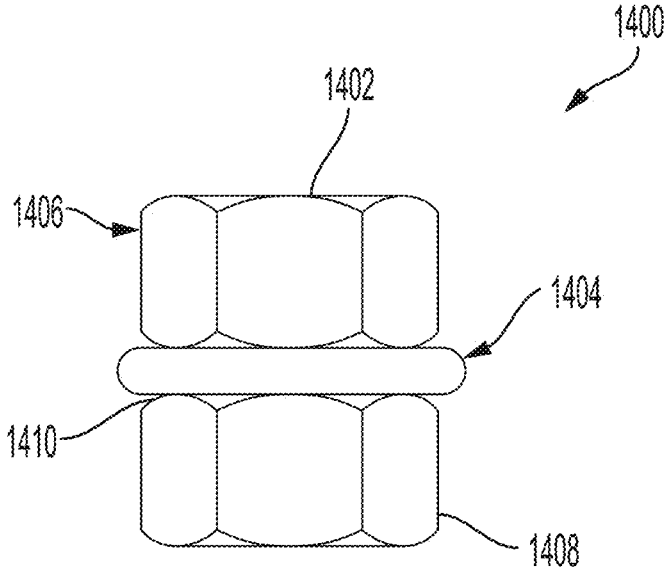
FIG. 14 is a side view of a shear-nut.

Referring to FIGS. 10-13, electrical connector 500 can have a size that includes first conductor 902 that is #6 SOL AL-4/0 to 6/1 STR ACSR having a diameter between 0.162 inches to 0.563 inches where "SOL" is solid wire; "ACSR" is Aluminum Conductor Steel Reinforced; "AL" is Aluminum (Material), and "STR" is Stranded Wire and second conductor 904 that is 4/0 (6/1) ACSR to 556.5 Kcmil (30/7) ACSR having a diameter between 0.563 inches to 0.953 inches where "Kcmil" is thousand circular mils (1 circular mil–Area of a circle with dia–1 mil (1 mil-1/1000 of an inch)). FIG. 10 shows electrical connector 500 having first conductor 902 having a diameter D1 of 0.563 inches that is a maximum diameter for first conductor 902 and second conductor 904 having a diameter D2 of 0.563 inches that is a minimum diameter for second conductor 904. FIG. 11 shows electrical connector 500 having first conductor 902 having a diameter D1 of 0.162 that is a minimum diameter for first conductor 902 and second conductor 904 having a diameter D2 of 0.563 inches that is a minimum diameter for second conductor 904. FIG. 12 shows electrical connector 500 having first conductor 902 having a diameter D1 of 0.563 that is a maximum diameter for first conductor 902 and second conductor 904 having a diameter D2 of 0.953 inches that is a maximum diameter for second conductor 904. FIG. 14 shows electrical connector 500 having first conductor 902 having a diameter D1 of 0.162 that is a minimum diameter for first conductor 902 and second conductor 904 having a diameter D2 of 0.953 inches that is a maximum diameter for second conductor 904. As shown in FIGS. 11 and 13, end flange 122 of first pad 502 overlaps second recess 124 of second pad 504 and end flange 122 of second pad 504 overlaps second recess 124 of first pad 502 securing first conductor 902 between first pad 502 and second pad 504 providing the anti back-out feature described above. A volume of a cast body of each of first pad 502 and second pad 504 of FIGS. 10-13 is 1.561 cubic inches and a volume of electrical connector 500 of FIGS. 10-13 is 3.648 cubic inches.

Referring to FIG. 14, instead of bolt body 512 receiving first flat washer 516, first Belleview washer 518, second Belleview washer 518, second flat washer 522 and nut 519, bolt body 512 can receive a torque-nut assembly 1400 to support spring 514. Torque-nut assembly 1400 is a shear nut. Torque-nut assembly 1400 has a nut 1402 and an O-ring 1404. Nut 1402 has a first nut member 1406 connected to a second nut member 1408 forming a socket 1410. O-ring 1404 fits in socket 1410. Second nut member 1408 is fully tightened with a wrench until a pressure applied exceeds a maximum torque limit, which causes second nut member 1408 of nut 1402 to break off of first nut member 1406. In some cases where the linemen does not have torque wrenches, torque-nut assembly 1400 can be used in-place.

This torque nut also enables the linemen to install first nut member 1406 with the required torque, for example, 240 newton meter, without using a torque wrench. Instead of bolt body 512 receiving torque-nut assembly 1400 or first flat washer 516, first Belleview washer 518, second Belleview washer 518, second flat washer 522 and nut 519, bolt body 512 can receive a flat washer, split lock washer and standard hex nut.

As compared with wire binding, electrical connector 500 will be a huge process improvement and also an efficient method with minimal losses. In particular, this electrical connector 500 will have a significant drop in "contact resistance" in the system, I squared R losses are also reduced and heat on the joints is reduced and conductor life is increased. Moreover, electrical connector 500 improves cost of installation, installation time, safety of installation and reliability over other conventional methods of tapping.

The present disclosure having been thus described with particular reference to the preferred forms thereof, it will be obvious that various changes and modifications may be made therein without departing from the spirit and scope of the present invention as defined in the appended claims.

It should be noted that the terms "first", "second", "third", "fourth", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure will not be limited to the particular embodiment(s) disclosed as the best mode contemplated, but that the disclosure will include all embodiments falling within the scope of the appended claims.

The invention claimed is:

1. An electrical connector comprising:

two pads having the same shape, each pad comprising a connector body having a first groove, a second groove, and a hole, the hole extending through the connector body between the first groove and the second groove;

a fastener extending through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position; and a spring between a first end of the fastener and one of the two pads having the same shape so that the spring biases the two pads having the same shape towards each other, wherein the connector body further includes a protruding tab on a first side and a side groove on a second side so that, when the two pads having the same shape are connected to one another, the protruding tabs are received in the side grooves, respectively.

2. The electrical connector of claim 1, wherein the side groove is sized to limit movement of the protruding tab.

3. The electrical connector of claim 1, wherein the two pads are bodies each having the same volume.

4. The electrical connector of claim 1, wherein the two pads having the same shape are cast bodies each having the same volume.

5. An electrical connector comprising:

two pads having the same shape, each pad comprising a connector body having a first groove, a second groove, and a hole, the hole extending through the connector body between the first groove and the second groove;

a fastener extending through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position; and a spring between a first end of the fastener and one of the two pads having the same shape so that the spring biases the two pads having the same shape towards each other, wherein the first groove has a first outer surface comprising a first flange and a first recess, wherein the first flange extends inward from a first side of the connector body a distance of half or less half an entire length of the first groove and the first recess extending inward from the first side of the connector body at least the distance of the first flange so that, when the two pads having the same shape are connected to one another, the first flanges are opposite and the first recesses, respectively.

6. The electrical connector of claim 5, wherein the second groove has a second outer surface comprising a second flange and a second recess, wherein the second flange extends inward from a second side of the connector body a distance of half or less half an entire length of the second groove and the second recess extends inward from the second side of the connector body at least the distance of the second flange so that, when the two pads having the same shape are connected to one another, the second flanges are opposite and the second recesses, respectively.

7. The electrical connector of claim 6, wherein the first flange is formed by a first receiving flange and a first protrusion, wherein the first receiving flange extends from the first groove at an angled direction away from the first groove and the protrusion is formed where the first receiving flange and the first groove meet and extends in a direction toward the first groove.

8. The electrical connector of claim 7, wherein the first receiving flange has a length of greater than 0.84 inches.

9. The electrical connector of claim 6, wherein the second flanges overlap the first recesses, respectively, when the second groove is free of the second conductor.

10. The electrical connector of claim 5, wherein the two pads having the same shape receive the first conductor having a diameter between 0.162 inches to 0.563 inches.

11. The electrical connector of claim 5, wherein the two pads having the same shape receive the second conductor having a diameter between 0.563 inches to 0.953 inches.

12. An electrical connector comprising:

two pads having the same shape, each pad comprising a connector body having a first groove, a second groove, and a hole, the hole extending through the connector body between the first groove and the second groove;

a fastener extending through the hole of both of the two pads having the same shape so that the two pads having the same shape are connected to one another and are pivotable around the fastener relative to one another with the two first grooves contacting a first conductor when the first conductor is in an installed position and the two second grooves contacting a second conductor when the second conductor is in an installed position; and a spring between a first end of the fastener and one of the two pads having the same shape so that the spring biases the two pads having the same shape towards each other, wherein the hole comprises an elongated portion and a recessed portion, and wherein the spring is received in the recessed portion of one of the two pads having the same shape and a second end of the fastener is received in the recessed portion of the other of the two pads having the same shape.

13. The electrical connector of claim 12, wherein the fastener has a fastener head and a fastener body, and wherein the recessed portion has a corresponding shape to the fastener head to prevent rotation of fastener in the opening.

14. The electrical connector of claim 12, wherein the recessed portion has a shape that corresponds to a shape of the spring to seat the spring.

15. The electrical connector of claim 12, wherein the fastener is a bolt having a head and a bolt body.

16. The electrical connector of claim 15, further comprising a Belleville washer secured on the bolt body with a nut.

17. The electrical connector of claim 15, wherein the bolt is connected to the two pads having the same shape by a shear-nut.

* * * * *